US009540970B2

(12) United States Patent
Popp et al.

(10) Patent No.: US 9,540,970 B2
(45) Date of Patent: Jan. 10, 2017

(54) VARIABLE LIFT VALVE TRAIN OF AN INTERNAL COMBUSTION ENGINE

(71) Applicant: Schaeffler Technologies AG & Co. KG, Herzogenaurach (DE)

(72) Inventors: Markus Popp, Bamberg (DE); Jan Pfannenmuller, Nuremberg (DE)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 2 days.

(21) Appl. No.: 14/624,837

(22) Filed: Feb. 18, 2015

(65) Prior Publication Data

US 2015/0233271 A1 Aug. 20, 2015

(30) Foreign Application Priority Data

Feb. 19, 2014 (DE) ..... 10 2014 203 001

(51) Int. Cl.
*F01L 1/34* (2006.01)
*F01L 13/00* (2006.01)

(52) U.S. Cl.
CPC .... *F01L 13/0036* (2013.01); *F01L 2013/0052* (2013.01)

(58) Field of Classification Search
CPC ..... F01L 13/0036; F01L 2013/0052
USPC ..... 123/90.16
See application file for complete search history.

(56) References Cited

U.S. PATENT DOCUMENTS 3,730,150 A * 5/1973 Codner, Jr. ..... F01L 13/0042 123/90.18
8,567,361 B2 10/2013 Gruberger
2011/0240892 A1* 10/2011 Nendel ..... F01L 1/047 251/129.01
2012/0227697 A1* 9/2012 Grunberger ..... F01L 1/053 123/90.18

FOREIGN PATENT DOCUMENTS

DE 102010012470 9/2011
DE 102010035185 3/2012
DE 102011001125 9/2012
DE 102011004912 9/2012

* cited by examiner

*Primary Examiner* — Zelalem Eshete
(74) *Attorney, Agent, or Firm* — Volpe and Koenig, P.C.

(57) ABSTRACT

A method for operating an internal combustion engine with a sliding cam valve train that has a cam part (2) with three adjacent cams of different lifts (H, M, L) and a groove-shaped connecting link path with two path sections (S1, S2) that lift in both axial directions of the cam part and are arranged completely one behind the other around the circumference is provided. An actuator (10) selectively couples two actuator pins (7, 8) in the connecting link path, in order to move the cam part. The base position of the cam part should be moved into a desired axial position during the operation of the internal combustion engine through successive coupling of the actuator pins in the connecting link path.

4 Claims, 5 Drawing Sheets

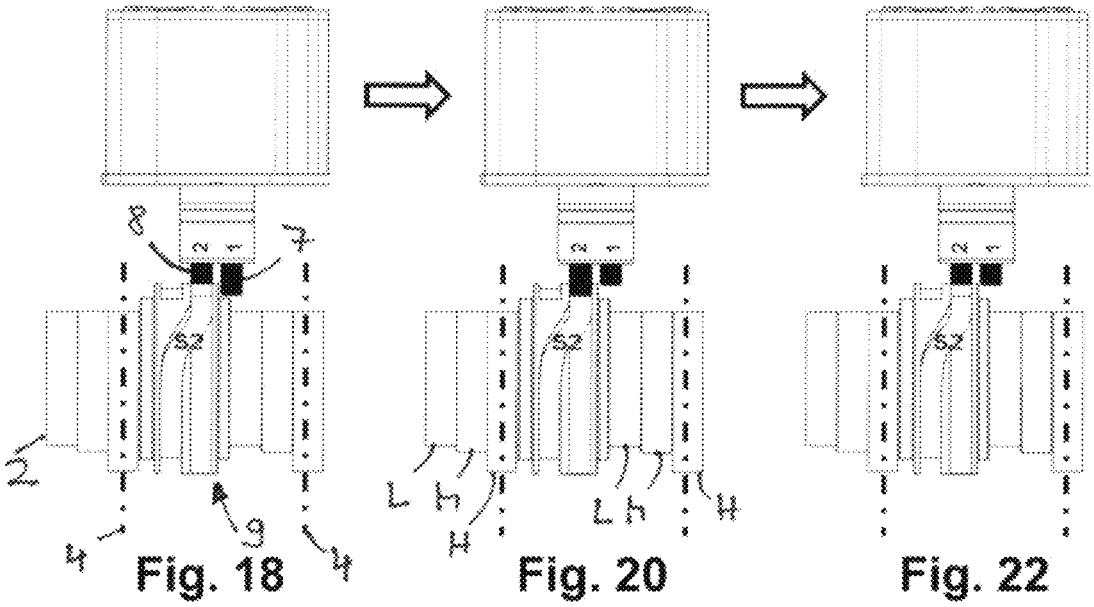
Fig. 18 Fig. 20 Fig. 22
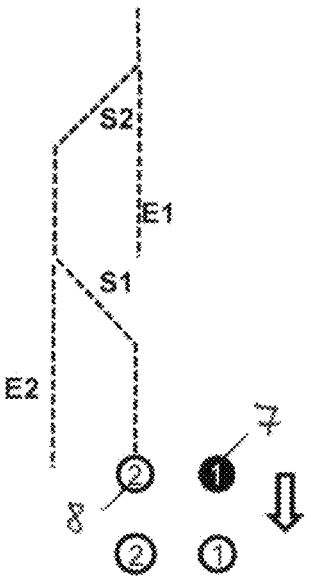
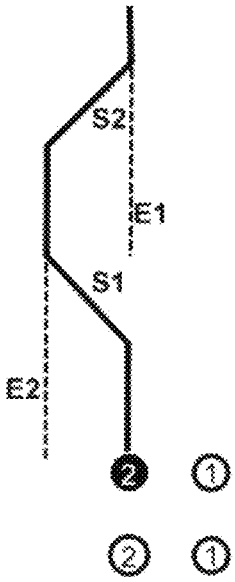
Fig. 19 Fig. 21

VARIABLE LIFT VALVE TRAIN OF AN INTERNAL COMBUSTION ENGINE

INCORPORATION BY REFERENCE

The following documents are incorporated herein by reference as if fully set forth: German Patent Application No. 102014203001.3, filed Feb. 19, 2014.

FIELD OF THE INVENTION

The invention relates to a method for operating an internal combustion engine with a variable lift gas-exchange valve train. The valve train has an actuator and a camshaft with a carrier shaft and a cam part that is rotationally locked on the carrier shaft and can move between three axial positions and has a group of three adjacent cams of different lifts and a groove-shaped connecting link path with two path sections that lift in both axial directions of the cam part and are arranged completely one behind the other over the circumference of the cam part. The actuator selectively extends two actuator pins that can be coupled in the connecting link path, in order to move the cam part to one of the axial positions.

BACKGROUND OF THE INVENTION

In such a gas exchange valve train that is generally also called a "sliding cam valve train," for error-free engine operation it is basically necessary that the cam lift instantaneously transferred to the gas exchange valve corresponds to the desired value as part of all of the instantaneously set operating parameters and consequently matches the instantaneous axial position of the cam part with its desired position. To be able to correct, if necessary, a defective actual axial position, until now the cam part position has been detected and this position is then compared with the desired axial position in the engine control module. The position detection is performed by evaluating sensor signals that actuate the actuator pin or pins in interaction with the connecting link path. As is provided, for example, in DE 10 2010 035 185 A1 and DE 10 2010 012 470 A1, the cam part can be constructed in the area of the connecting link path so that each axial position can be uniquely identified by a characteristic current signal profile. This also applies to DE 10 2011 004 912 A1 from which it is known to detect a position of the cam part in a sliding cam valve train of the type noted above.

SUMMARY

The object of the invention is to provide an operating method for an internal combustion engine in which the axial position of the cam part can be set in a defined way without the complexity for its previously mentioned position detection.

This objective is met using one or more features of the invention. Here, the base position of the cam part should be moved into a desired axial position during the operation of the internal combustion engine by the following control of the actuator:

a) Extending a first of the actuator pins at a circumferential path position that lies in front of a first of the path sections and behind the second path section, b) Holding the first actuator pin in the extended position within a circumferential path angle that encloses the two path sections at least once, c) Retracting the first actuator pin from a circumferential path position that lies behind the second path section and in front of the first path section, d) Extending the second actuator pin at a circumferential path position that lies in front of the first path section and behind the second path section, e) Holding the second actuator pin in the extended position within a circumferential path angle that encloses the two path sections at least once, f) Retracting the second actuator pin from a circumferential path position that lies behind the second path section and in front of the first path section.

Here, the axial lift of the second path section specifies the axial direction of the cam part base position and the second actuator pin is adjacent to the first actuator pin in the axial direction of the cam part base position.

The invention is based on the surprising effect that the knowledge of the instantaneous actual axial position of the cam part is not absolutely necessary to move the cam part into a (defined) desired axial position in the case of a desired actual deviation. This takes place, instead, "automatically," namely in two successive phases such that the two actuator pins are extended and retracted one after the other and each within a camshaft angle interval encompassing both path sections. Here, the cam part is always shifted into the same end position independent of its original axial position, including in the case that the cam part is already located in this end position. This method according to the invention for setting the base position of the cam part is suitable, in particular, for the rotational speed ramp-up period in the startup phase of the internal combustion engine in which the actual axial position of the cam part and typically in multiple cylinder engines obviously the actual axial positions of the cam parts are not (yet) known because the sensors are not yet available to the engine control module.

With respect to the basic end position of the cam part, two cases are to be distinguished:

a) The two path sections are traversed in the same sequence by the two actuator pins. In this first case, the basic position of the cam part is in one of its outer axial positions.

b) The two path sections are traversed in the reverse sequence by the two actuator pins. In this second case, the basic position of the cam part is in its central axial position.

BRIEF DESCRIPTION OF THE DRAWINGS

Additional features of the invention are given from the following description and from the drawings in which the method according to the invention is shown with reference to two embodiments. If not mentioned otherwise, features or components that are identical or that have identical functions are provided with identical reference symbols. Shown are:

FIG. 18 shows the cam part with actuator in a starting position in which the cam part is already located in the basic left end position, FIG. 19 shows schematically the first basic position phase of the cam part without its position change due to the actuation of the first actuator pin, FIG. 20 shows the cam part with actuator in the unchanged end position, FIG. 21 shows schematically the second basic position phase of the cam part in the basic end position due to the actuation of the second actuator pin, FIG. 22 shows the cam part with actuator in the left end position.

DETAILED DESCRIPTION OF THE PREFERRED EMBODIMENTS

Figure 1:
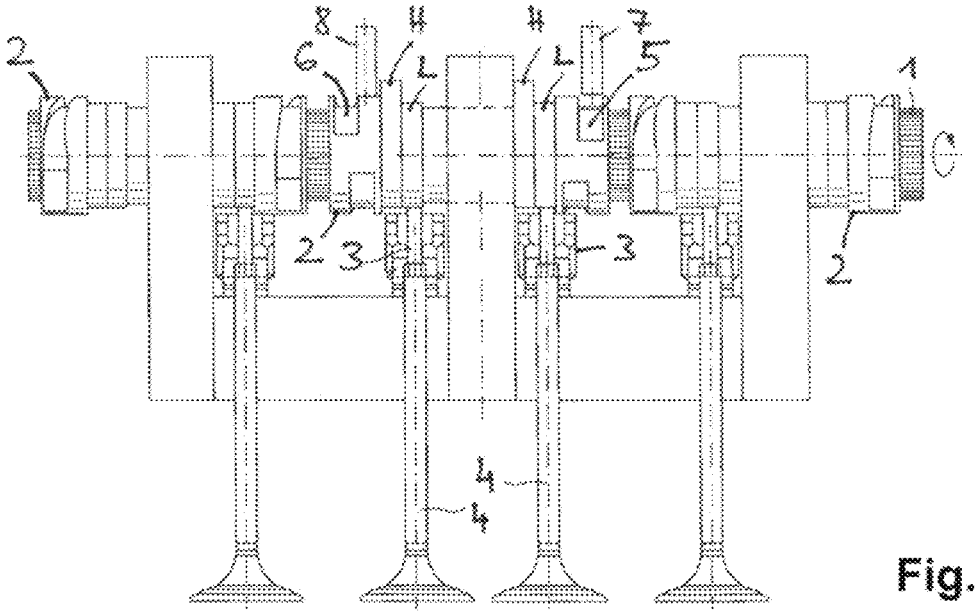
FIG. 1 is a partial side view of a known sliding cam valve train.
Figure 2:
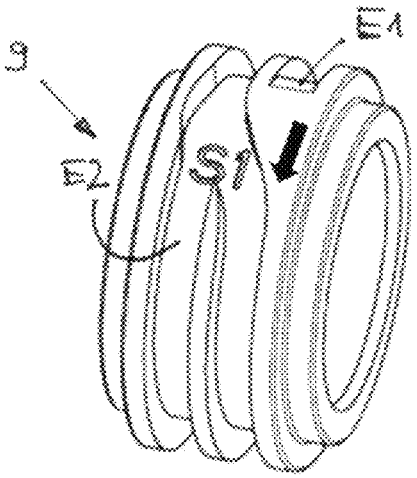
FIG. 2 in a view isolated from the cam part, an axial connecting link in a first perspective view on the connecting link path.
Figure 3:
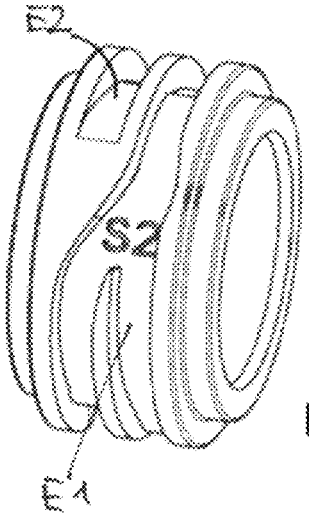
FIG. 3 shows the axial connecting link according to FIG. 2 in a second view rotated relative to the first view.
Figure 4:
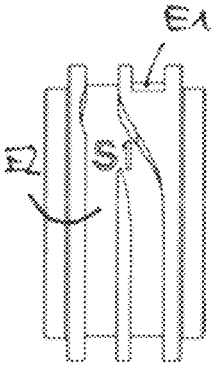
FIG. 4 shows the axial connecting link according to FIG. 2 in a first top view of the first path section.
Figure 5:
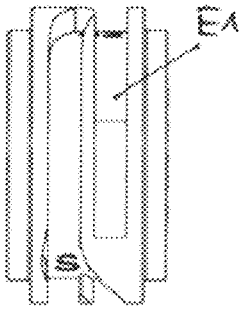
FIG. 5 shows the axial connecting link according to FIG. 4 in a top view rotated by approx. 90°.
Figure 6:
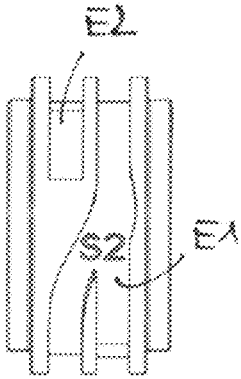
FIG. 6 shows the axial connecting link according to FIG. 4 in a top view of the second path section rotated by approx. 180°.
Figure 7:
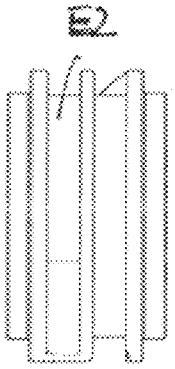
FIG. 7 shows the axial connecting link according to FIG. 4 in a top view rotated by approx. 270°.

The invention will be explained starting with FIG. 1 in which a known stroke-variable gas exchange valve train of a multiple cylinder internal combustion engine is shown. The basic functional principle of the valve train can be summarized in that a conventional rigid camshaft is replaced by an externally toothed carrier shaft 1 and cam parts 2 that are rotationally locked on this shaft by internal teeth and supported so that they can move in the axial direction. Each cam part has two groups of cams that are directly adjacent in the axial direction with two different magnitude lifts H and L that are transferred selectively by cam followers 3 to the two intake-side or exhaust-side gas exchange valves 4 of each cylinder. The movement of the cam part on the carrier shaft necessary for the operating point-dependent activation of each cam takes place via two axial connecting links running separately on the cam part with groove-shaped connecting link paths 5 and 6 that lift according to the movement direction in both axial directions of the cam part and in which an actuator pin 7 or 8 of an actuator (not shown) extends depending on the instantaneous position of the cam part.

FIGS. 2 to 7 show, in isolated representation, an axial connecting link 9 that is suitable for the method according to the invention with a groove-shaped connecting link path in which the two path sections are arranged not next to each other as in FIG. 1, but instead completely one behind the other over the circumference of the cam part 2, so that they transition one into the other in the circumferential direction. In this way, the first path section that is designated below with S1 and essentially lifts with the width of a cam in the figures in the left axial direction of the cam part causes a movement of the cam part by an axial position to the right when this rotates in the direction of the arrow according to FIG. 2 and an actuator pin (7 or 8 in FIG. 1) is coupled in the connecting link path in the circumferential area of this first path section. Conversely, the second path section that is designated below with S2 and lifts in the figures in the right axial direction of the cam part causes a movement of the cam part by an axial position to the left when an actuator pin is coupled in the connecting link path in the circumferential area of this second path section.

The extending and timely coupling of the actuator pins from the actuator and into the connecting link path is simplified by retraction grooves E1 and E2 that each run axially offset relative to the connecting link path and open into the connecting link path in the area of the two path sections S1 and S2. The first retraction groove E1 begins—with respect to the rotational direction shown in FIG. 2—approximately at the end of the first path section S1 (see FIGS. 2 and 4) and opens in the second path section S2 (see FIGS. 3 and 6). The second retraction groove E2 begins approximately with the end of the second path section S2 (see FIGS. 3 and 6) and opens in the first path section S1 (see FIGS. 2 and 4). Additional structural details of the axial connecting link are to be found in the unpublished DE 10 2013 223 299 whose complete disclosure is incorporated herein by reference as if fully set forth.

The following figures show the basic position method of the cam part 2 according to the invention on its three possible starting positions in the desired axial position. The basic positions are set during rotational speed ramp-up of the internal combustion engine beginning from the time at which the angular position and the rotational speed of the basic position setting camshaft are known to the engine control module. The cam part has two groups each of three adjacent cams with the different lifts H, M, and L and the axial connecting link 9 arranged between the cam groups according to the previously explained FIGS. 2 to 7. The two actuator pins 7 and 8 are actively extended and also retracted selectively by a double actuator 10, in order to move the cam part by one of the three axial positions. The numbering "1" and "2" shown on the actuator 10 and in the circles indicates the time sequence below in which the actuator pins are controlled, in order to move the basic position of the cam part during two successive basic position phase into the desired axial position. This also applies to the path sections S1 and S2, whose numbering only refers to the sequence in which the two path sections or their circumferential path angles are traversed only in pairs and at least once first by the extended first actuator pin and then by the extended second actuator pin.

The first basic position phase thus begins so that the actuator extends the first actuator pin at a circumferential path position that is located in front of the first path section S1 and behind the second path section S2. The actuator pin is held in the extended position until it has traversed the circumferential angle of both path sections once. The first basic position phase thus ends so that the actuator 10 retracts the first actuator pin from a circumferential path position that is located behind the second path section and in front of the first path section. The second basic position phase is realized through analogous actuation of the second actuator pin.

The basic position of the cam part 2 is set from the three possible starting positions into an outer axial position of the cam part only when the axial lift of the second path section S2 specifies the axial direction in which the basic position of the cam part is set and when the second actuator pin is adjacent to the first actuator pin in the axial direction of the cam part basic position.

The basic position setting desired axial position is always the left position of the cam part 2 in the first embodiment in FIGS. 8 to 22. Consequently, in this example, the second path section is the path section S2, because this section moves the cam part rotating in the shown rotational direction to the left. In the same direction of consideration, it is applicable accordingly for the axial arrangement of the actuator pins that the second actuator pin is adjacent at the left from the first actuator pin, so that, in this example, the second actuator pin of the left relative position of the actuator pin 8 corresponds to actuator pin 7 in FIG. 1.

In the left end position of the cam part 2, the right cam pair with the high lift H actuates the gas exchange valves 4 symbolized by the dash dot lines (see FIG. 1). In other constructions, the cam lifts can obviously be arranged differently on the cam part, so that then the gas exchange valve pair in the basic axial position can also be actuated by the low lift L or the medium lift M or an intermediate combination from the lifts H, M, and L.

Figures 8, 10, 12:
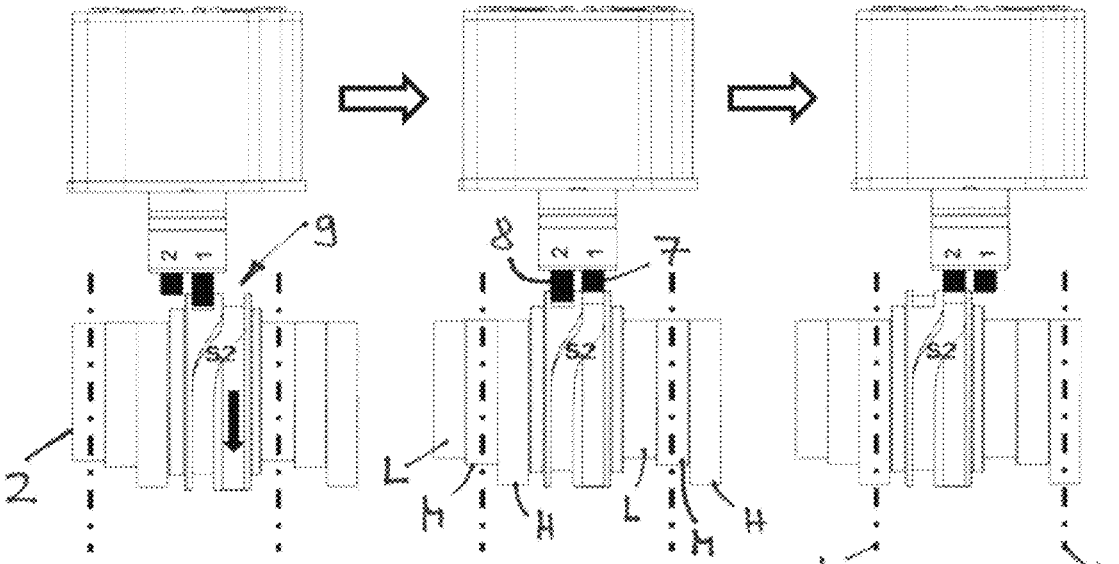
FIG. 8 shows a cam part with actuator in a starting position in which the cam part is located on the right.
FIG. 10 shows the cam part with actuator in the intermediate position.
FIG. 12 shows the cam part with actuator in the end position in which the cam part is located on the left.
Figures 9, 11:
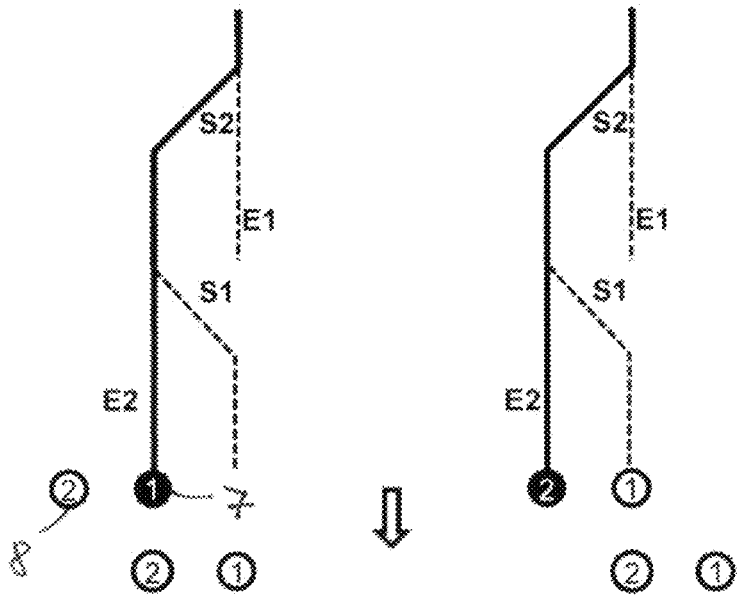
FIG. 9 shows schematically the first base position phase of the cam part in the central intermediate position due to the actuation of the first actuator pin.
FIG. 11 shows schematically the second base position phase of the cam part in the basic end position due to the actuation of the second actuator pin.

FIGS. 8 to 12: The starting position of the cam part 2 is the right axial position in which the gas exchange valves 4 are actuated with the cam lift L according to FIG. 8. In the first basic position phase, the cam part is moved to the left by an axial position. The movement process is shown schematically in FIG. 9 and is performed such that the first actuator pin 7 is extended and coupled into the retraction groove E2, in order to then move the cam part along the second path section S2 to the left. At the end of the first basic position phase, the cam part is located in the central intermediate position in which, according to FIG. 10, the cam lift M acts on the gas exchange valves. The first actuator pin 7 is now located at the axial height of the first retraction groove E1 and the second actuator pin 8 is located at the axial height of the retraction groove E2. This is shown in FIG. 9 at the bottom and in FIG. 11 at the top.

In the second basic position phase, the cam part 2 is moved to the left by another axial position into the desired axial position in which, according to FIG. 12, the cam lift L is active. The movement process is shown in FIG. 11 and is performed such that the second actuator pin 8 is extended and likewise coupled in the retraction groove E2, in order to move the cam part again along the second path section S2 to the left into the basic end position.

Figures 13, 15, 17:
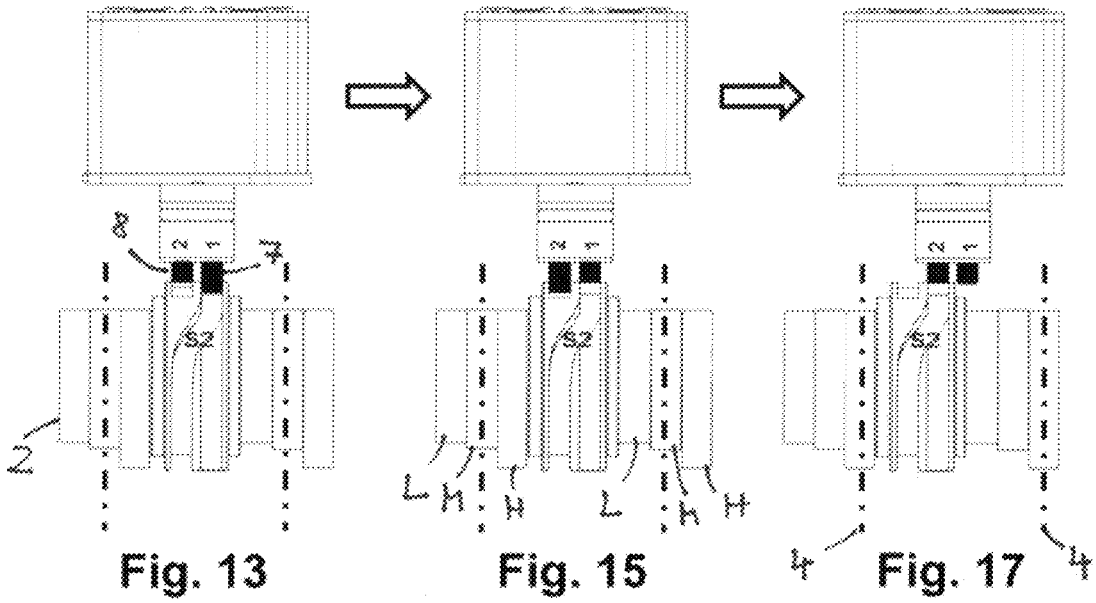
FIG. 13 shows the cam part with actuator in the central starting position.
FIG. 15 shows the cam part with actuator in the intermediate position.
FIG. 17 shows the cam part with actuator in the left end position.
Figures 14, 16:
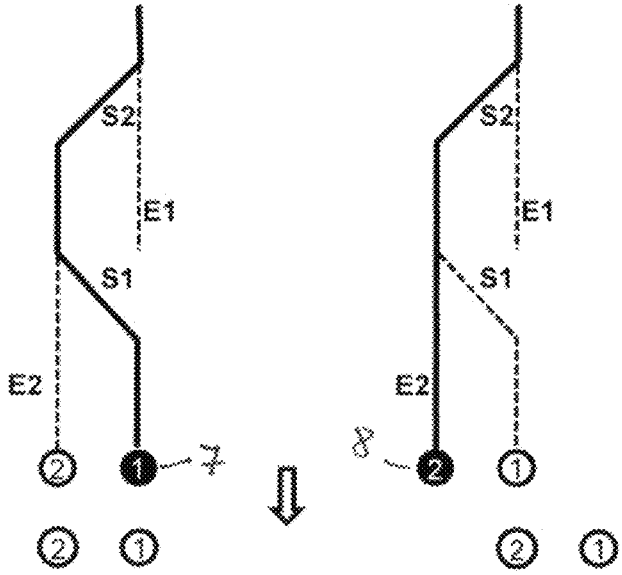
FIG. 14 shows schematically the first basic position phase of the cam part in the intermediate position due to the actuation of the first actuator pin.
FIG. 16 shows schematically the second basic position phase of the cam part in the basic end position due to the actuation of the second actuator pin.

FIGS. 13 to 17: The starting position of the cam part 2 is the central axial position in which the gas exchange valves 4 are actuated with the cam lift M according to FIG. 13. In the first basic position phase, the cam part is initially moved to the right by an axial position and then back to the left, so that the axial position overall remains unchanged according to FIG. 15. The movement process of this double switch is shown in FIG. 14 and is performed such that the first actuator pin 7 is extended and coupled into the retraction groove E1 in order to move the cam part first along the first path section S1 to the right and then back along the second path section S2 to the left.

In the second basic position phase, the cam part 2 is moved by means of the second actuator pin 8 by an axial position to the left into the left end position. The movement process shown in FIGS. 15 to 17 is identical to the second basic position phase according to FIGS. 10 to 12.

FIGS. 18 to 22: The starting position of the cam part 2 shown in FIG. 18 is already the basic left end position according to FIG. 22. In the first basic position phase, the cam part is not moved, so that its axial position remains unchanged according to FIG. 20. As shown in FIG. 19, in this case the first actuator pin 7 extends axially next to the axial connecting link 9, so that, due to the lack of engagement with the connecting link path, there can be no movement of the cam part.

In the second basic position phase, a double switch is performed so that the axial position of the cam part 2 remains unchanged. In this case, the double switch shown in FIG. 21 is released from the second actuator pin 8.

The alternative case b) mentioned above with respect to the basic central end position would be realized in the first embodiment according to FIGS. 8 to 22 when the first actuator pin 7 has traversed the two path sections or their circumferential angle in the sequence S1-S2 and when, conversely, the second actuator pin 8 has traversed the two path sections or their circumferential angle in the sequence S2-S1.

The second embodiment shown in FIGS. 23 to 28 differs from the previously explained first example by the mirror-inverted axial orientation of the connecting link path on the other cam part 2. In this case, because the second path section S2 runs to the left and accordingly the cam part moves to the right, the basic desired axial position in the second embodiment is always the right position of the cam part 2. Thus, for the axial arrangement of the actuator pins 7 and 8 it is applicable that the second actuator pin is at the right of the first actuator pin in the control sequence and is, in this case, the actuator pin 7.

Figure 23:
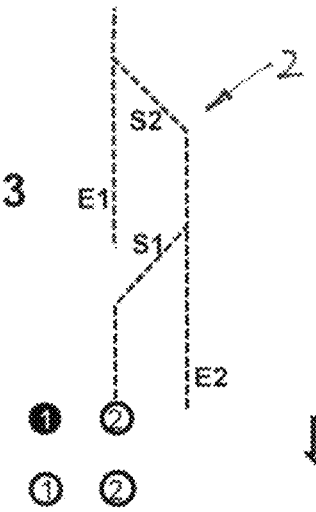
FIG. 23 shows schematically the first basic position phase of another cam part from a right starting position into the central intermediate position, wherein the other cam part has a connecting link path oriented in the opposite direction and wherein the two actuator pins are actuated in the reverse sequence.
Figure 24:
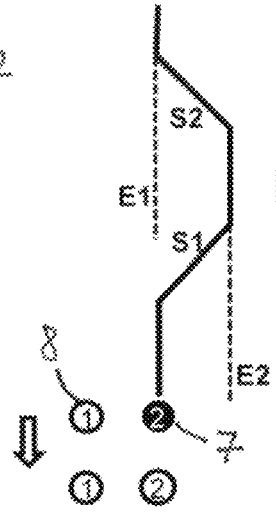
FIG. 24 shows schematically the second basic position phase of the other cam part in the basic end position in which the cam part is located on the right side.

FIGS. 23 and 24: Analogous to the FIGS. 19 and 21, the starting position of the basic position setting cam part 2 is already the right end position. Consequently, in the two basic position phases, there is initially no switching and then a double switch of the cam part is performed.

Figure 25:
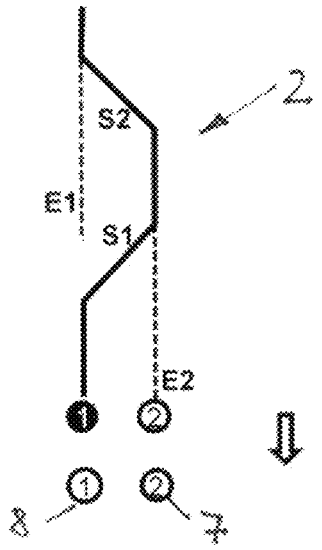
FIG. 25 shows schematically the first basic position phase of the other cam part from a central starting position without position change.
Figure 26:
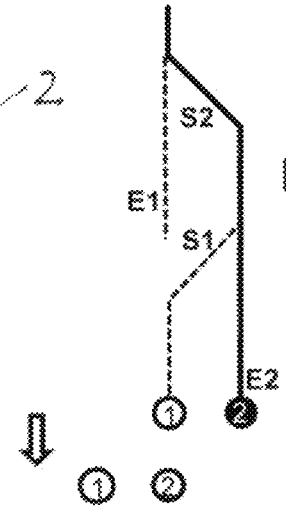
FIG. 26 shows schematically the second basic position phase of the other cam part in the right end position.

FIGS. 25 and 26: Analogous to the FIGS. 14 and 16, the starting position of the basic position setting cam part 2 is the central axial position. Consequently, in the two basic position phases, there is initially a double switch and then a movement of the cam part to the right into the end position.

Figure 27:
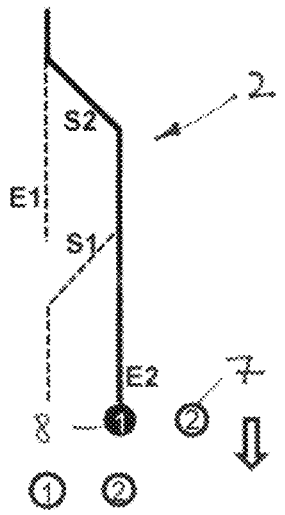
FIG. 27 shows schematically the first basic position phase of the other cam part from a left starting position into the intermediate position.
Figure 28:
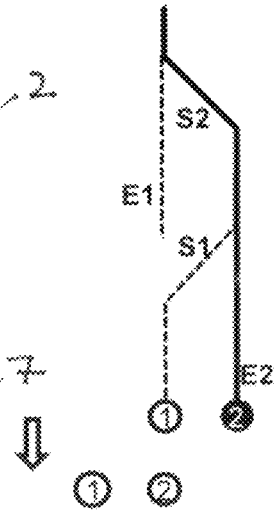
FIG. 28 shows schematically the second basic position phase of the other cam part into the right end position.

FIGS. 27 and 28: Analogous to the FIGS. 9 and 11, the starting position of the basic position setting cam part 2 is the left axial position. Consequently, in the two basic position phases, there is a movement of the cam part to the right into the end position.

The alternative case b) mentioned above with respect to the basic central end position would then be realized in the second embodiment according to FIGS. 23 to 28 when the first actuator pin 8 has traversed the two path sections or their circumferential angle in the sequence S1-S2 and when, conversely, the second actuator pin 7 has traversed the two path sections or their circumferential angle in the sequence S2-S1.

LIST OF REFERENCE NUMBERS

1 Carrier shaft
2 Cam part
3 Cam follower
4 Gas-exchange valve
5 Connecting link path
6 Connecting link path
7 Actuator pin
8 Actuator pin
9 Axial connecting link
10 Actuator

The invention claimed is:

1. A method for operating an internal combustion engine with a lift-variable gas-exchange valve train comprising an actuator and a camshaft with a carrier shaft and a cam part that is rotationally locked on the carrier shaft and is movable between three axial cam positions and has a group of three adjacent cams of different lifts and a groove-shaped connecting link path with a first path section and a second path section that lift in both axial directions of the cam part and are arranged completely one behind the other over a circumference of the cam part, the actuator being actuatable to selectively extend first and second actuator pins that are couplable into the connecting link path, in order to move the cam piece to one of the axial positions, and the cam part is reset into an outer target axial position during operation of the internal combustion engine, the first actuator pin in a base position phase is extended and retracted and the second actuator pin in a following second base position phase is extended and retracted, wherein the actuator is controlled as follows:

a) extending the first actuator pin at a circumferential path position that lies in front of the first path section and behind the second path section,
b) holding the first actuator pin in an extended position within a circumferential path angle that encloses the two path sections at least once,
c) retracting the first actuator pin from a circumferential path position that lies behind the second path section and in front of the first path section,
d) extending the second actuator pin at a circumferential path position that lies in front of the first path section and behind the second path section,
e) holding the second actuator pin in the extended position within a circumferential path angle that encloses the two path sections at least once,
f) retracting the second actuator pin from a circumferential path position that lies behind the second path section and in front of the first path section, wherein the axial lift of the second path section shifts the cam part in the axial direction and wherein the second actuator pin is adjacent to the first actuator pin in the axial direction of the cam part base position.

2. The method according to claim 1, further comprising performing steps (a)-(f) in the cam part base positions during a rotational speed run-up of a starting of the internal combustion engine.

3. The method according to claim 1, wherein the gas-exchange valve is actuated in the cam part base position of the cams with a greatest lift.

4. A method for operating an internal combustion engine with a lift-variable gas-exchange valve train comprising an actuator and a camshaft with a carrier shaft and a cam part that is rotationally locked on the carrier shaft and is movable between three axial cam positions and has a group of three adjacent cams of different lifts and a groove-shaped connecting link path with a first path section and a second path section that lift in both axial directions of the cam part and are arranged completely one behind the other over a circumference of the cam part, the actuator being actuatable to selectively extend first and second actuator pins that are couplable into the connecting link path, in order to move the cam piece to one of the axial positions, and the cam part is reset into a middle target axial position during operation of the internal combustion engine, the first actuator pin in a base position phase is extended and retracted and the second actuator pin in a following second base position phase is extended and retracted, wherein the actuator is controlled as follows:

a) extending the first actuator pin at a circumferential path position that lies in front of the first path section and behind the second path section,
b) holding the first actuator pin in an extended position within a circumferential path angle that encloses the two path sections at least once,
c) retracting the first actuator pin from a circumferential path position that lies behind the second path section and in front of the first path section,
d) extending the second actuator pin at a circumferential path position that lies in front of the second path section and behind the first-path section,
e) holding the second actuator pin in the extended position within a circumferential path angle that encloses the two path sections at least once,
f) retracting the second actuator pin from a circumferential path position that lies behind the first second path section and in front of the first path section, wherein the axial lift of the second path section shifts the cam part in the axial direction, in which the second actuator pin is adjacent to the first actuator pin.

* * * * *